US012163726B2

(12) United States Patent
Park et al.

(10) Patent No.: US 12,163,726 B2
(45) Date of Patent: Dec. 10, 2024

(54) REFRIGERATOR

(71) Applicant: SAMSUNG ELECTRONICS CO., LTD., Suwon-si (KR)

(72) Inventors: Hyunnam Park, Suwon-si (KR); Hyunbum Kim, Suwon-si (KR); Jisick Hwang, Suwon-si (KR); Taesu An, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 183 days.

(21) Appl. No.: 17/870,149

(22) Filed: Jul. 21, 2022

(65) Prior Publication Data

US 2023/0095672 A1 Mar. 30, 2023

Related U.S. Application Data

(63) Continuation of application No. PCT/KR2022/008550, filed on Jun. 16, 2022.

(30) Foreign Application Priority Data

Sep. 24, 2021 (KR) ..... 10-2021-0126717

(51) Int. Cl.
*F25D 23/06* (2006.01)
*F25D 23/02* (2006.01)
*F25D 23/04* (2006.01)

(52) U.S. Cl.
CPC ..... *F25D 23/062* (2013.01); *F25D 23/028* (2013.01); *F25D 23/04* (2013.01); *F25D 2323/02* (2013.01); *F25D 2331/806* (2013.01)

(58) Field of Classification Search
CPC .... F25D 23/028; F25D 23/04; F25D 2323/02; F25D 2381/806
See application file for complete search history.

(56) References Cited

U.S. PATENT DOCUMENTS

2006/0027609 A1* 2/2006 Landau ..... G01F 11/18 222/434
2006/0254302 A1* 11/2006 Byrne ..... G07F 11/24 221/256

(Continued)

FOREIGN PATENT DOCUMENTS

CN 206583167 U 10/2017
CN 111829279 A 10/2020

(Continued)

OTHER PUBLICATIONS

English translation of CN111829279 from espacenet (Year: 2024).*

(Continued)

*Primary Examiner* — Daniel J Rohrhoff
(74) *Attorney, Agent, or Firm* — STAAS & HALSEY LLP

(57) ABSTRACT

A refrigerator including: a main body; a storage room inside the main body; a door opening and closing the storage room; and a food dispenser installed on the door and configured to withdraw food to outside. The food dispenser includes: a food withdrawal portion, and a food storage portion being detachable from the food withdrawal portion and provided above the food withdrawal portion, and the food storage portion includes an opening and closing device including: a resting body forming an outlet through which food stored in the food storage portion moves, the resting body rested on the food withdrawal portion; a push member coupled with the resting body and being movable in a front-rear direction; a shutter moving in an opposite direction of a moving direction of the push member by interworking with the push member to open and close the outlet; and a locker to lock the shutter.

15 Claims, 13 Drawing Sheets

(56) References Cited

U.S. PATENT DOCUMENTS

| | | | | |
|---|---|---|---|---|
| 2009/0229284 | A1* | 9/2009 | Fulton | F25C 5/187 62/344 |
| 2010/0276442 | A1* | 11/2010 | Querfurth | F25D 23/12 62/449 |
| 2016/0368756 | A1* | 12/2016 | Yang | B67D 3/0009 |
| 2023/0083329 | A1* | 3/2023 | Kwon | F25D 23/04 62/389 |

FOREIGN PATENT DOCUMENTS

| | | | | |
|---|---|---|---|---|
| JP | 2010-500531 | | 1/2010 | |
| KR | 20-2000-010537 | | 6/2000 | |
| KR | 10-0412022 | | 12/2003 | |
| KR | 10-0829124 | B1 | 5/2008 | |
| KR | 10-0852671 | B1 | 8/2008 | |
| KR | 10-0852672 | | 8/2008 | |
| KR | 10-2008-0095364 | A | 10/2008 | |
| KR | 20-0465464 | Y1 | 2/2013 | |
| WO | WO-2008130200 | A2 * | 10/2008 | F25D 23/04 |

OTHER PUBLICATIONS

International Search Report dated Sep. 30, 2022 in International Patent Application No. PCT/KR2022/008550 (3 pages; 4 pages English Translation).

PCT/ISA/237 dated Sep. 30, 2022 in International Patent Application No. PCT/KR2022/008550 (4 pages).

* cited by examiner

REFRIGERATOR

CROSS-REFERENCE TO RELATED APPLICATION(S)

This application is a continuation application, under 35 U.S.C. § 111(a), of International Application No. PCT/KR2022/008550, filed on Jun. 16, 2022, which claims priority to Korean Patent Application No. 10-2021-0126717, filed on Sep. 24, 2021 in the Korean Intellectual Property Office, the disclosure of which is incorporated by reference herein in its entirety.

BACKGROUND

1. Field

The disclosure relates to a refrigerator, and more particularly, to a dehydrated food dispenser installed on a door.

2. Description of the Related Art

A refrigerator is an appliance including a main body having a storage room and a cool air supply system for supplying cool air to the storage room to keep foods fresh. The storage room includes a refrigerating room that is maintained at about 0° C. to 5° C. to keep foods refrigerated and a freezing room that is maintained at about 0° C. to 30° C. below zero to keep foods frozen. Generally, the storage room opens at the front side to put/take food into/out, and the open front side of the storage room is opened or closed by doors.

Refrigerators are classified into several types according to the positions of the storage rooms and the types of the doors. Refrigerators are classified into a Top Mounted Freezer (TMF) type in which a storage room is partitioned into upper and lower spaces by a horizontal partition wall to form a freezing room in the upper space and a refrigerating room in the lower space, and a Bottom Mounted Freezer (MMF) type in which a refrigerating room is formed in the upper space and a freezing room is formed in the lower space. Also, there are a Side By Side (SBS) type in which a storage room is partitioned into left and right spaces by a vertical partition wall to form a freezing room in one side and a refrigerating room in the other side, and a French Door Refrigerator (FDR) type in which a storage room is partitioned into upper and lower spaces by a horizontal partition wall to form a refrigerating room in the upper space and a freezing room in the lower space, wherein the refrigerating room is opened or closed by a pair of doors.

There is a refrigerator with a dehydrated food dispenser storing grain to maintain the grain fresh. The dehydrated food dispenser is installed on a door of the refrigerator.

SUMMARY

In accordance with an aspect of the disclosure, a refrigerator includes: a storage room; a door to open and close the storage room; and a food dispenser attachable to and detachable from an interior side of the door, wherein the food dispenser includes: a food storage portion having a food storage case for storing items, and an opening and closing assembly coupled with a lower portion of the food storage case to discharge the items stored in the food storage case; and a food withdrawal portion provided below the food storage portion and accommodating the items discharged from the food storage portion, the opening and closing assembly includes: a resting body having an outlet through which the items stored in the food dispenser is discharged, the resting body attachable to and detachable from an upper surface of the food withdrawal portion; a push member coupled with the resting body in such a way as to be movable along a front-rear direction of the food dispenser; and a shutter being movable along an opposite direction of a moving direction of the push member by interworking with the push member, and opening and closing the outlet.

The push member may be movable between a first position of closing the outlet and a second position of opening the outlet.

The opening and closing assembly may further include a locker to limit movement of the shutter.

The push member may include: a button positioned in front of the resting body; and a first rack gear formed to extend from the button to the resting body, and positioned at both sides of the outlet.

The shutter may include a second rack gear being movable along the opposite direction of the moving direction of the push member between the first position of closing the outlet and the second position of opening the outlet by interworking with the push member.

The opening and closing assembly may further include a transfer gear moving the second rack gear along an opposite direction of a moving direction of the first rack gear, while changing a gear ratio of the first rack gear and the second rack gear.

The opening and closing assembly may further include a pair of springs of which a first end is fixed to the resting body and a second end is coupled with the first rack gear, wherein the pair of springs may elastically bias the push member to move the push member to the first position.

The shutter may further include a catching protrusion, and the locker may include a locker body, and a catching member formed to protrude from the locker body and prevent the catching protrusion from moving.

The opening and closing assembly may further include a locker guide coupled with the food withdrawal portion and guiding an up-down movement of the locker.

The locker may unlock the shutter upon coupling of the resting body with the food withdrawal portion.

The shutter may further include a shutter protrusion preventing the items from being lumped together.

The food withdrawal portion may include a housing on which the resting body is rested, and a food withdrawal container being withdrawable from the housing to an outside of the housing, and the housing may be hook-coupled with the resting body.

The housing may include an upper surface, a side wall recessed downward from the upper surface and guiding the resting body, and a guide surface extending from the side wall, and the resting body may include a lower surface corresponding to the upper surface and coupled with the upper surface, and a resting surface recessed downward from the lower surface and rested on the guide surface.

The resting body may include an insertion protrusion protruding downward from the lower surface toward a rear direction, and a coupling protrusion located at a more front position than the insertion protrusion, and the housing may include an insertion groove in which the insertion protrusion is inserted, and a fixing protrusion hook-coupled with the coupling protrusion.

The food dispenser may further include: a food storage case; and a cover opening and closing the food storage case; and a coupling member coupling the food storage case with the resting body.

In accordance with another aspect of the disclosure, a refrigerator includes: a main body; a storage room formed inside the main body; a pair of doors opening and closing the storage room; and at least one food dispenser detachably installed on at least one of the pair of doors, wherein the food dispenser includes a food withdrawal portion including a housing and a food withdrawal container being withdrawable from the housing, and a plurality of food storage portions being detachable from the housing and provided above the housing, and each of the plurality of food storage portions includes an opening and closing device including a resting body forming an outlet through which gain stored in the food storage portion moves, the resting body rested on the housing, a push member coupled with the resting body and being movable in a front-rear direction, and a shutter moving in an opposite direction of a moving direction of the push member by interworking with the push member.

The push member may be movable between a first position of closing the outlet and a second position of opening the outlet.

The opening and closing device may further include a locker locking a movement of the shutter.

The push member may include: a button positioned in front of the resting body; and a first rack gear extending from the button to the resting body, and positioned at both sides of the outlet, wherein the shutter may include a second rack gear being movable in an opposite direction of a moving direction of the push member between a first position of closing the outlet and a second position of opening the outlet by interworking with the push member.

In accordance with still another aspect of the disclosure, a refrigerator includes: a main body; a storage room formed inside the main body; a door opening and closing the storage room; a food withdrawal portion installed on a lower portion of the door, and configured to withdraw food to outside; and a food storage portion being detachable from the food withdrawal portion, and provided above the food withdrawal portion, wherein the food storage portion includes an opening and closing device including a resting body forming an outlet through which food stored in the food storage portion moves, the resting body rested on the food withdrawal portion, a push member coupled with the resting body and being movable in a front-rear direction, a shutter moving in an opposite direction of a moving direction of the push member by interworking with the push member, and opening and closing the outlet, and a locker locking the shutter.

BRIEF DESCRIPTION OF THE DRAWINGS

The above and other aspects, features, and advantages of certain embodiments of the present disclosure will be more apparent from the following description taken in conjunction with the accompanying drawings of which.

DETAILED DESCRIPTION

Figure 1:
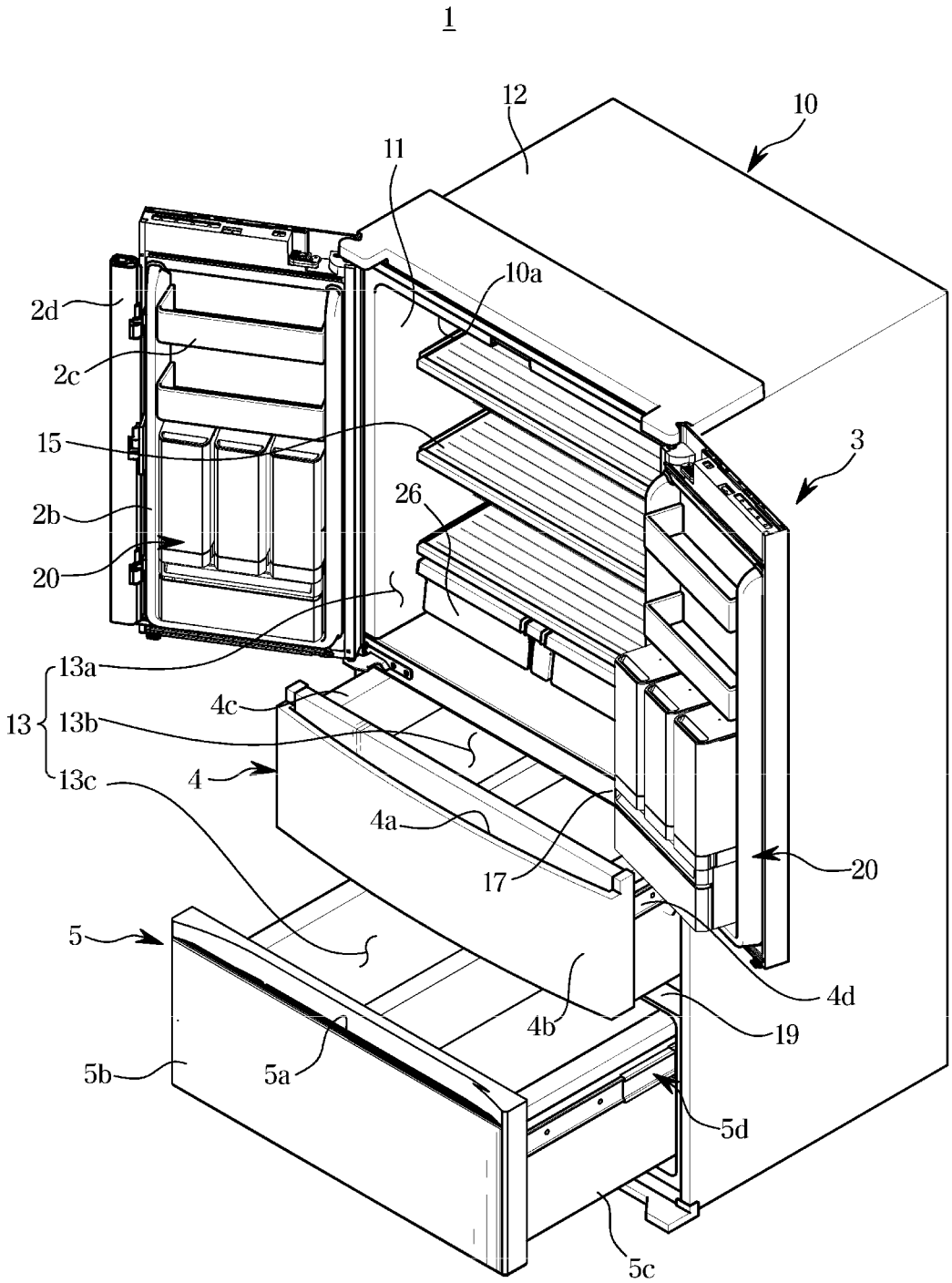
FIG. 1 is a perspective view showing a refrigerator according to an example.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "rear", "left", and "right" are defined based on the drawings, and the shapes and positions of the components are not limited by the terms.

Throughout the disclosure, the expression "at least one of a, b or c" indicates only a, only b, only c, both a and b, both a and c, both b and c, all of a, b, and c, or variations thereof.

Hereinafter, an example will be described in detail with reference to the accompanying drawings.

Therefore, it is an aspect of the disclosure to provide a refrigerator having a food dispenser that is detachable from the refrigerator to enable a user to easily put grain therein.

It is another aspect of the disclosure to provide a refrigerator having a food dispenser in which a food storage case is separated from a food withdrawal portion to enable a user to more easily clean the food storage case and the food withdrawal portion upon cleaning of the food dispenser.

It is still another aspect of the disclosure to provide a refrigerator capable of preventing grain from pouring through an outlet while a food storage case is separated from a food withdrawal portion.

Additional aspects of the disclosure will be set forth in part in the description which follows and, in part, will be obvious from the description, or may be learned by practice of the disclosure. Referring to FIG. 1, a refrigerator 1 may include a main body 10, a storage room 13 formed by partitioning inside of the main body 10 into upper and lower spaces, a plurality of doors 2, 3, 4, and 5 opening and closing the storage room 13, and a cool air supplier (not shown) for supplying cool air to the storage room 13.

The main body 10 may include an inner case 11 forming the storage room 13, an outer case 12 coupled with an outer side of the inner case 11 and forming an outer appearance, and a main body insulation (not shown) foamed between the inner case 11 and the outer case 12 to insulate the storage room 13. The inner case 11 may be injection-molded with a plastic material, and the outer case 12 may be made of a metal material. The main body insulation may be urethane foam insulation, and a vacuum insulation panel may be used together with the urethane foam insulation as necessary.

The cool air supplier may generate cool air by using a cooling circulation cycle of compressing, condensing, expanding, and evaporating a refrigerant.

The storage room 13 may be partitioned into a plurality of spaces by a plurality of partitions 17 and 19, and a plurality of shelves 15 and a storage container 26 may be provided inside the storage room 13 to store food, etc.

The storage room 13 may be partitioned into a plurality of storage rooms 13*a*, 13*b*, and 13*c* by the partitions 17 and 19. The partitions 17 and 19 may include a first partition 17 and a second partition 19. The first partition 17 may be installed horizontally inside the storage room 13 to form an upper storage room (or a first storage room) 13*a* and a middle storage room (or a second storage room) 13*b*. The second partition 19 may be installed horizontally inside the storage room 13 to form the middle storage room (or the second storage room) 13*b* and a lower storage room (or a third storage room) 13*c*. The first partition 17 and the second partition 19 may partition the storage room 13 into three spaces.

However, such partitioning of the storage room 13 is an example, and the storage rooms 13*a*, 13*b*, and 13*c* may be partitioned differently from the above description.

The storage room 13 may be opened and closed by the doors 2, 3, 4, and 5. The doors 2, 3, 4, and 5 may include a pair of first doors (or upper doors) 2 and 3 for opening and closing the upper storage room 13*a*. The doors 2, 3, 4, and 5 may include a second door (or a middle door) 4 for opening and closing the middle storage room 13*b*. The doors 2, 3, 4, and 5 may include a third door (or a lower door) 5 for opening and closing the lower storage room 13*c*. The pair of first doors 2 and 3, the second door 4, and the third door 5 may open and close the front opening 10*a* of the main body 10. The pair of first doors 2 and 3 may be a pair of doors 2 and 3.

The third door 5 may include a lower door portion 5*b* for shutting an open front side of the lower storage room 13*c*, and a lower basket 5*c* coupled with a rear surface of the lower door portion 5*b*. The lower basket 5*c* may be slidingly supported by a lower rail 5*d*. The third door 5 may be opened and closed through a third door handle 5*a*.

The middle storage room 13*b* may be opened and closed by the second door 4 slidingly coupled with the main body 10. The second door 4 may be opened and closed through a second door handle 4*a*. The second door handle 4*a* may be formed by being depressed from an upper surface of the second door 4.

The second door 4 may include a middle door portion 4*b* covering an open front side of the middle storage room 13*b*, and a middle basket 4*c* coupled with a rear surface of the middle door portion 4*b*. The middle basket 4*c* may be slidingly supported by a middle rail 4*d*.

In any one of the pair of first doors 2 and 3, a rotating bar 2*d* may be provided. The rotating bar 2*d* may seal a gap between the pair of first doors 2 and 3 upon closing of the pair of first doors 2 and 3. In the main body 10, a rotating bar guide for guiding a movement of the rotating bar 2*d* may be provided.

The refrigerator 1 may include a food dispenser 20 installed on the first doors 2 and 3. The food dispenser 20 may be installed on both the pair of first doors 2 and 3 or on any one of the first doors 2 and 3. Also, the food dispenser 20 may be provided independently inside the refrigerator 1. A plurality of food dispensers 20 may be provided. The food dispenser 20 may include a plurality of food storage cases 40 (see FIG. 2) or a single food storage case 40 for storing grain.

Hereinafter, for convenience of description, one of the first doors 2 and 3 will be described, and the remaining one will be not described. However, the first door 2 or 3 which will be not described may have the same configuration as the first door 2 or 3 which will be described below, except that the first door 2 or 3 which will be not described is mirror-symmetrical to the first door 2 or 3 which will be described below. Also, the second door 4 and/or the third door 5 may have the same configuration as the first door 2 or 3.

The upper storage room 13*a* may be opened and closed by the first door 2 or 3 rotatably coupled with the main body 10. The first door 2 or 3 may be opened and closed through a first door handle. The first door handle may be formed by being recessed in a lower surface of the first door 2 or 3.

On a rear surface of the first door 2 or 3, a door shelf 2*c* for storing food may be provided. The door shelf 2*c* may include a shelf supporter 2*b* extending vertically from the first door 2 or 3 to support the door shelf 2*c* at left and right sides of the door shelf 2*c*. The shelf supporter 2*b* may be provided as a separate configuration in such a way as to be detachable from the first door 2 or 3, and, for example, the shelf supporter 2*b* may protrude backward from the rear surface of the first door 2 or 3 and extend in an up-down direction.

A process of coupling the food dispenser 20 with the first door 2 or 3 will be described with reference to FIG. 2. The food dispenser 20 may include a groove 71 at left and right sides. The first door 2 or 3 may include a protrusion 3*a*. A pair of protrusions 3*a* may be provided. The protrusion 3*a* of the first door 2 or 3 may be inserted into the groove 71 in the up-down direction. By inserting the protrusion 3*a* into the groove 71, the food dispenser 20 may be installed on the first door 2 or 3. By the structure, a user may easily separate the food dispenser 20 from the first door 2 or 3. In the drawing, the food dispenser 20 is shown to be coupled with the first door 2 or 3. However, the food dispenser 20 may be coupled to the first door 2 or 3.

Figure 2:
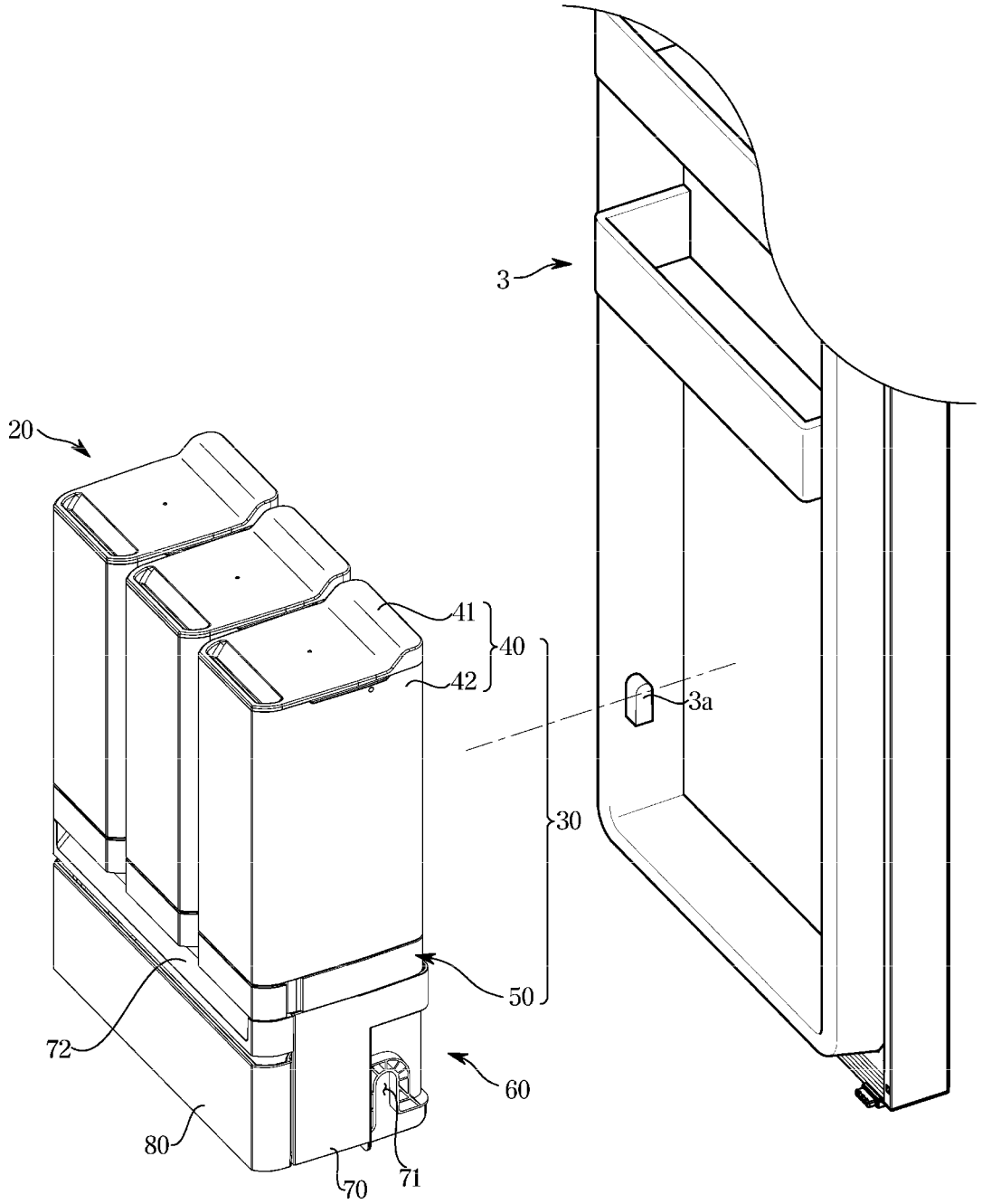
FIG. 2 shows a food dispenser installed on a door of a refrigerator according to an example.
Figure 3:
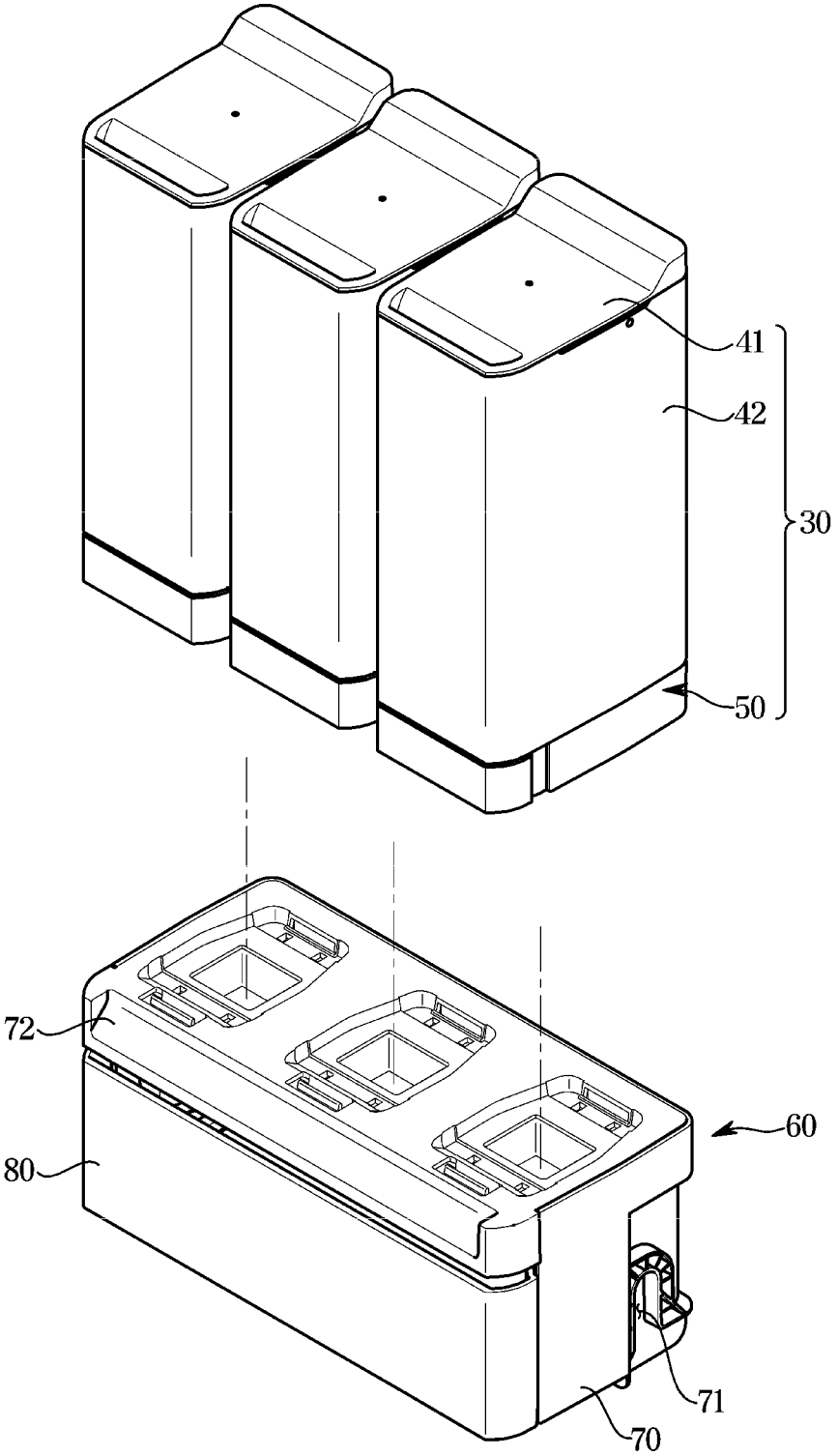
FIG. 3 shows a detachable state of the food dispenser shown in FIG. 2.
Figure 4:
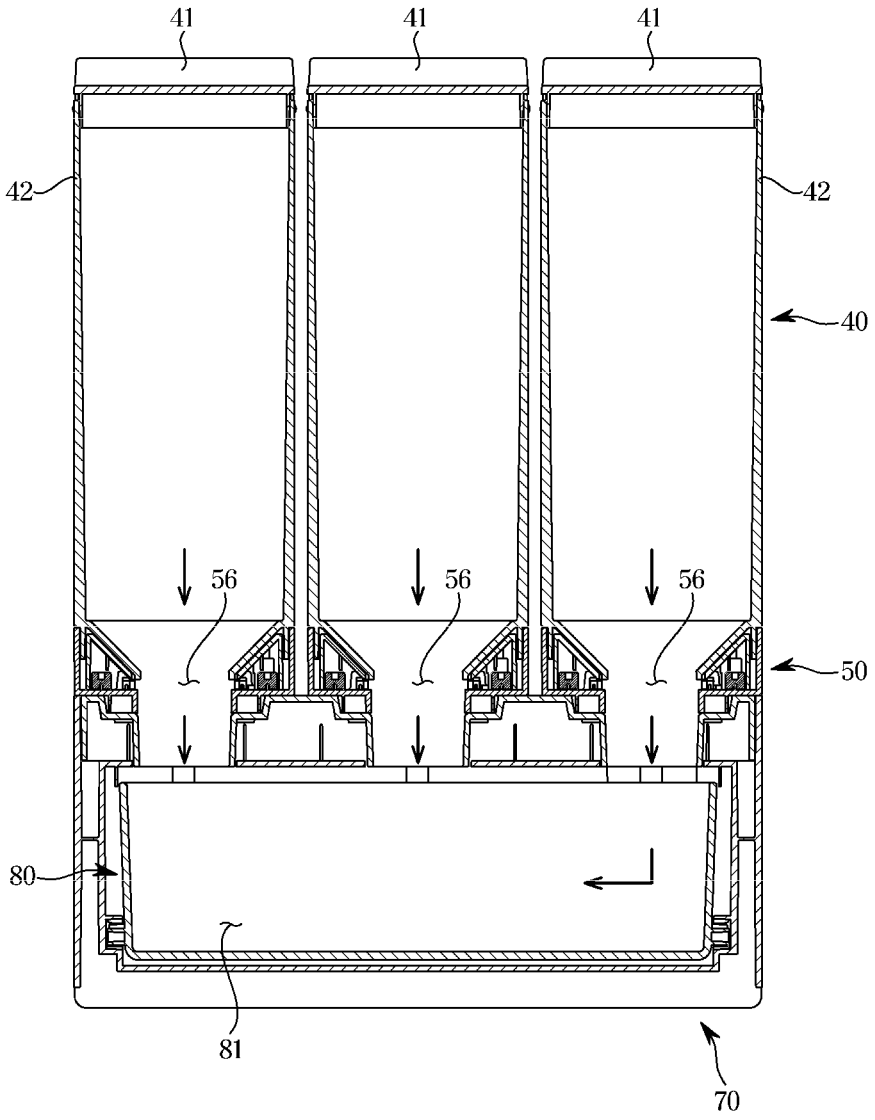
FIG. 4 is a front view of the food dispenser shown in FIG. 2.

Referring to FIGS. 2 to 4, the food dispenser 20 may include a food storage portion 30 and a food withdrawal portion 60. In the food dispenser 20, grain stored in the food storage portion 30 may be withdrawn to outside through the food withdrawal portion 60. The food storage portion 30 may be separable from the food withdrawal portion 60. The food withdrawal portion 60 may be provided below the food storage portion 30 and coupled with the food storage portion 30. A plurality of food storage portions 30 may be provided.

In the drawing, three food storage portions 30 may be provided, although not limited thereto. Hereinafter, each of the food storage portions 30 will be described as the food storage portion 30. The food storage portions 30 may have structures corresponding to each other. Hereinafter, grain may be food or dehydrated food, although not limited thereto.

The food storage portion 30 may include a food storage case 40 in which grain is stored, and an opening and closing device 50 (also referred to as an opening and closing assembly 50) for opening and closing an outlet 56 that transfers grain from the food storage case 40 to the food withdrawal portion 60. The food storage case 40 may include a storage body 42, and a cover 41 provided above the storage body 42.

The food withdrawal portion 60 may include a housing 70, and a food withdrawal container 80 that is withdrawable in a front-rear direction (X direction) from the housing 70. Inside the food withdrawal container 80, an accommodating space 81 may be formed. A single food withdrawal container 80 may be provided, or the food withdrawal container 80 may be provided by a number corresponding to the food storage portion 30.

Grain may be stored in the food storage case 40. The grain stored in the food storage case 40 may move to the accommodating space 81 of the grain withdrawal portion 60 via the outlet 56 opened by the opening and closing device 50. A user may withdraw the food withdrawal container 80 in the front-rear direction (X direction) to withdraw the grain stored in the accommodating space 81 to the outside.

Figure 5:
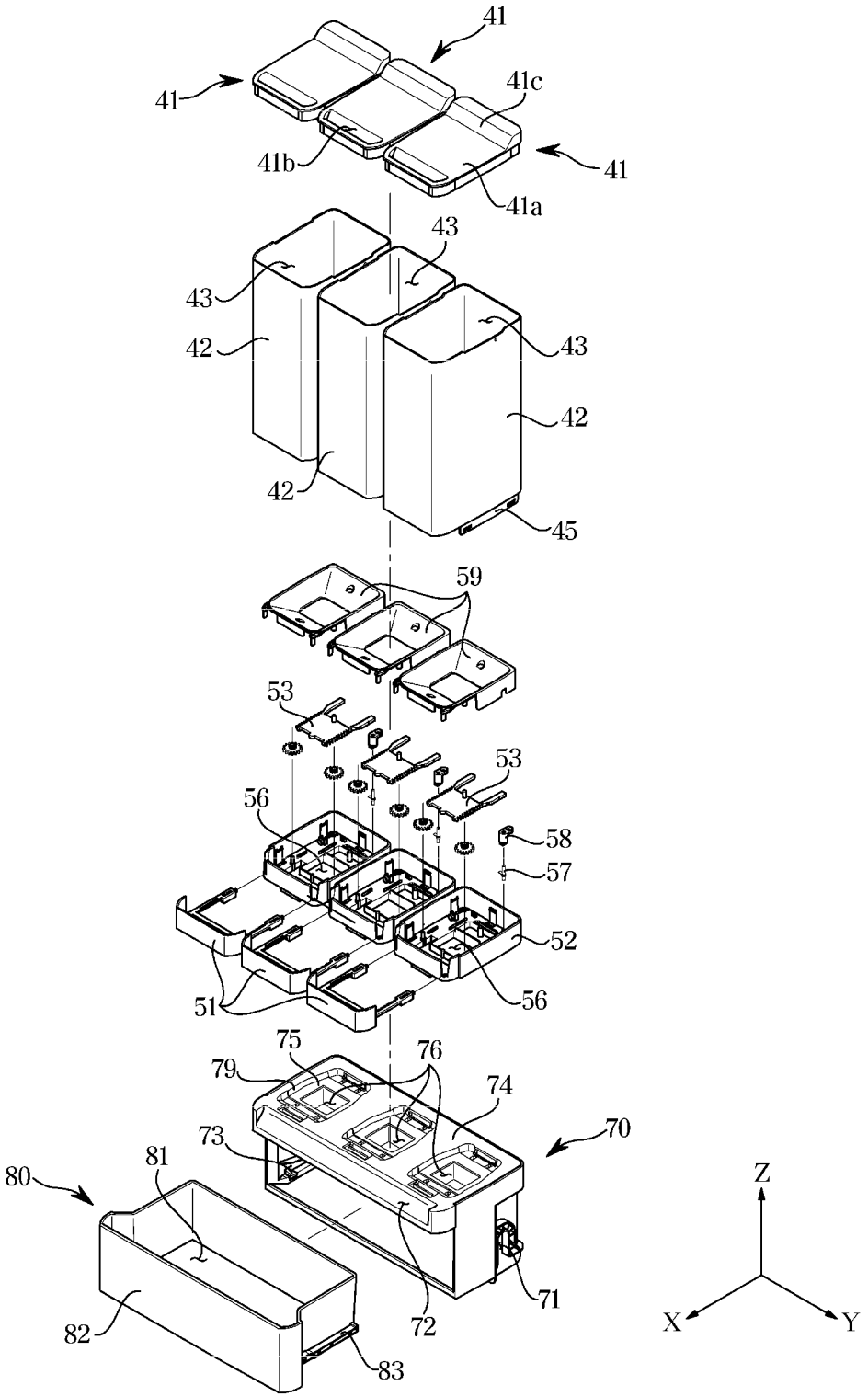
FIG. 5 is an exploded perspective view of a food storage portion and a food withdrawal portion shown in FIG. 2.

Referring to FIG. 5, the cover 41 may be provided above the storage body 42 and coupled with the storage body 42. The cover 41 may include a recess 41*b* recessed downward from a cover body 41*a*, and an inclined surface 41*c* protruding from the cover body 41*a* in such a way as to be inclined upward toward a rear direction (−X direction). The recess 41*b* may be located at a more front position (X direction) than the inclined surface 41*c*.

A user may put a hand into the recess 41*b* to move the cover 41 in the rear direction (−X direction). Thereby, the user may store grain in a food inserting space 43 by the recess 41*b*. The user may move the cover 41 in the rear direction (−X direction) by pressing the inclined surface 41 slopingly protruding from the cover body 41*a* of the cover 41 in the rear direction. Hereinafter, the front and rear directions will be described based on the X direction of FIG. 5.

The opening and closing device 50 may include a push member 51, a resting body 52, a shutter 53, and a locker 57. The resting body 52 may form the outlet 56 through which grain stored in the food storage case 40 moves, and may be rested on the housing 70 of the food withdrawal portion 60. More specifically, the resting body 52 may be rested on a resting surface 75 and an upper surface 74 of the housing 70.

The push member 51 may be provided in front of the resting body 52 and coupled with the resting body 52. The push member 51 may be coupled with the resting body 52 in such a way as to be movable in the front direction (X direction).

The resting body 52 may form the outlet 56 and be coupled with the push member 51 and the shutter 53. The resting body 52 may be provided in an upper side (Y-axis direction) of the food withdrawal portion 60 and coupled with the food withdrawal portion 60.

The shutter 53 may be provided in an upper side of the resting body 52 (in the Z-axis direction) and coupled with the resting body 52. The shutter 53 may move in an opposite direction of the front direction (X direction) of the push member 51 by interworking with the push member 51. As the push member 51 moves in the rear direction (−X direction), the shutter 53 may move in the front direction (X direction). As the push member 51 moves in the front direction (X direction), the shutter 53 may move in the rear direction (−X direction). The shutter 53 may move in the front direction (X direction) to open the outlet 56, and move in the rear direction (−X direction) to close the outlet 56. That is, as the push member 51 moves in the rear direction (−X direction), the shutter 53 may move in the front direction (X direction) to open the outlet 56, and accordingly, grain stored in the food storage case 40 may move to the accommodating space 81 through the outlet 56.

The locker 57 may be provided in the upper side of the resting body 52 (in the Z direction) and coupled with the resting body 52. The locker 57 may lock a movement of the shutter 53. The locker 57 may be coupled with the resting body 52 together with a locker guide 58.

A coupling member 59 may be provided between the resting body 52 and the food storage case 40.

The food withdrawal portion 60 may include the housing 70, and the food withdrawal container 80 that may be withdrawn in the front-rear direction from the housing 70. The housing 70 may include the groove 71 that is coupled with the protrusion 3*a*. The housing 70 may include an inclined surface 72 positioned in the front direction (X direction) and having an inclined shape. By the structure, the resting body 52 and the food storage case 40 may be easily lifted through the inclined surface 72, and accordingly, a user may separate the resting body 52 from the housing 70 with a smaller force.

The housing 70 may include the upper surface 74, and a side wall 79 recessed downward from the upper surface 74 to form a recess. The housing 70 may include the resting surface 75 extending from one end of the side wall 79. The resting surface 75 may form a food communicating opening 76 communicating with the outlet 56. The housing 70 may include a rail guide 73.

The food withdrawal container 80 may include the accommodating space 81 in which grain is accommodated, and a front wall 82 positioned in front of the accommodating space 81. The food withdrawal container 80 may include rails 83 at both sides. Each rail 83 may be coupled with the rail guide 73 of the housing 70. The food withdrawal container 80 may move in the front direction (X direction) from the housing 70 through the rail 83.

Coupling of the opening and closing device 50 will be described in detail with reference to FIGS. 6 and 7. The opening and closing device 50 may include the resting body 52, the push member 51 coupled with the resting body 52 in the front direction (X direction), and the shutter 53 coupled with the upper side of the resting body 52.

The resting body 52 may include a front wall 52*a*, a left wall 52*ab*, a rear wall 52*ac*, and a right wall 52*ad*. The left wall 52*ab* and the right wall 52*ad* may be spaced from the front wall 52*a* to form an insertion opening 52*aa*. A pair of insertion openings 52*aa* may be provided. The front wall 52*a* may be opposite to the rear wall 52*ac*, and the left wall 52*ab* may be opposite to the right wall 52*ad*.

An inclined protrusion 52*i* may protrude from the left wall 52*ab* in such a way as to be inclined downward. An inclined portion 52*i* may also protrude from the right wall 52*ab* in such a way as to be inclined downward. The resting body 52 may be coupled with a side plate 45 (see FIG. 5) of the storage body 42 (see FIG. 5) through the inclined protrusion 52*i*. More specifically, the inclined protrusion 52*i* may be coupled with an opening of the side plate 45 to couple the resting body 52 with the storage body 42 (see FIG. 5).

The resting body 52 may include a spring holder 52*c* that is coupled with a spring 54. A pair of spring holders 52*c* may be provided. The spring holder 52*c* may protrude upward from a bottom of the resting body 52. The spring holder 52*c* may fix one end of the spring 54 to maintain coupling between the spring 54 and the resting body 52.

The resting body 52 may include a shutter holder 52*d* positioned behind the shutter 53 to prevent the shutter 53 from moving in the rear direction. The shutter holder 52*d* may be positioned behind the outlet 56. That is, the shutter holder 52*d* may prevent the shutter 53 being at a position closing the outlet 56 from moving in the rear direction.

The resting body 52 may include a first bottom protrusion 52*e* positioned in front of the outlet 56 (X direction), and a second bottom protrusion 52*f*. The first bottom protrusion 52*e* may be located at a more front position (X direction) than the second bottom protrusion 52*f*.

The push member 51 may include a button 51*a* to enable a user to press. The push member 51 may include first rack gears 51*b* extending in the rear direction (−X direction) from the button 51*a* in such a way as to be opposite to each other. The first rack gears 51*b* may be a pair of first rack gears 51*b*. The first rack gears 51*b* may be positioned at both sides of the outlet 56 (see FIG. 9). The pressing protrusion 51*c* of the push member 51 may be positioned at a rear end (in the −X direction) of the pair of first rack gears 51*b*. The other end of the push member 51 may be the button 51*a*. The first rack gears 51*b* and the pressing protrusion 51*c* of the push member 51 may be inserted into inside of the resting body 53 through the insertion opening 52*aa*. The button 51*a* may be formed to correspond to the front wall 52*a* of the resting body 52.

The shutter 53 may be positioned on the upper side of the resting body 52 to open or close the outlet 56. The shutter 53 may include a shutter body 53*a*, and a second rack gear 53*b* provided at both sides of the shutter body 53*a*. The second rack gear 53*b* may be a pair of second rack gears 53*b*. The shutter 53 may include a catching protrusion 53*d* positioned at a rear end (in the −X direction) of the second rack gear 53*b*.

The shutter 53 may include a shutter protrusion 53*c* protruding upward (in the Z direction) from the shutter body 53*a*. The shutter protrusion 53*c* may prevent grain from being lumped. That is, by the structure, grain stored in the food storage case 40 (see FIG. 2) may be prevented from being lumped. Grain may be smaller than the outlet 56. Grain may be lumped together and increase in volume. In this case, the grain may fail to smoothly move through the outlet 56, and the shutter protrusion 53*c* may prevent grain from being lumped.

The opening and closing device 50 may include a transfer gear 55 for connecting the first rack gears 51*b* with the second rack gears 53*b*. The transfer gear 55 may include a first gear 55*a* and a second gear 55*b* positioned below (in the −Z direction) the first gear 55*a*. The first gear 55*a* may be engaged with the first rack gears 51*b*, and the second gear 55*b* may be engaged with the second rack gears 53*b*.

The first rack gears 51*b* may be positioned farther from the outlet 56 than the second rack gears 53*b*. More specifically, a distance between the pair of first rack gears 51*b* may be longer than a distance between the pair of second rack gears 53*b*. The pair of first gears 55*a* may be respectively engaged with the first rack gears 51*b*. The pair of second gears 55*b* may be engaged with the second rack gears 53*b* in such a way as to be opposite to each other. By the structure, the push member 51 including the first rack gears 51*b* may move in an opposite direction of a moving direction of the shutter 53 including the second rack gears 53*b* by interworking with the shutter 53. That is, the opening and closing device 50 having a small size may form the outlet 56 having a sufficiently great size.

A number of teeth of each first gear 55*a* may be different from that of teeth of each second gear 55*b*. The number of teeth of the first gear 55*a* may be smaller than that of teeth of the second gear 55*b*. A size of the first gear 55*a* may be smaller than that of the second gear 55*b*. The first rack gear 51*b* engaged with the first gear 55*a* may move farther than the second rack gear 53*b* engaged with the second gear 55*b*. That is, the push member 51 may move farther than the shutter 53. By the structure, a user's slight pressing operation of pressing the push member 51 will not open the outlet 56 and also, an unintended pressing operation will not fully open the outlet 65 to prevent grain from pouring through the outlet 56.

The opening and closing device 50 may include the locker 57 for locking a movement of the shutter 53. The locker 57 may be coupled with the locker guide 58 through a locker hole 58*b*. The locker guide 58 may be coupled with the resting body 52 through a locker fixing protrusion 52*h* protruding upward (Z direction) from the resting body 52. More specifically, the locker fixing protrusion 52*h* may be inserted into a protrusion hole 58*a* to couple the resting body 52 with the locker guide 58.

The opening and closing device 50 may include the spring 54 of which one end is fixed to the spring holder 52*c* and the other end is coupled with the push member 51.

Figure 8:
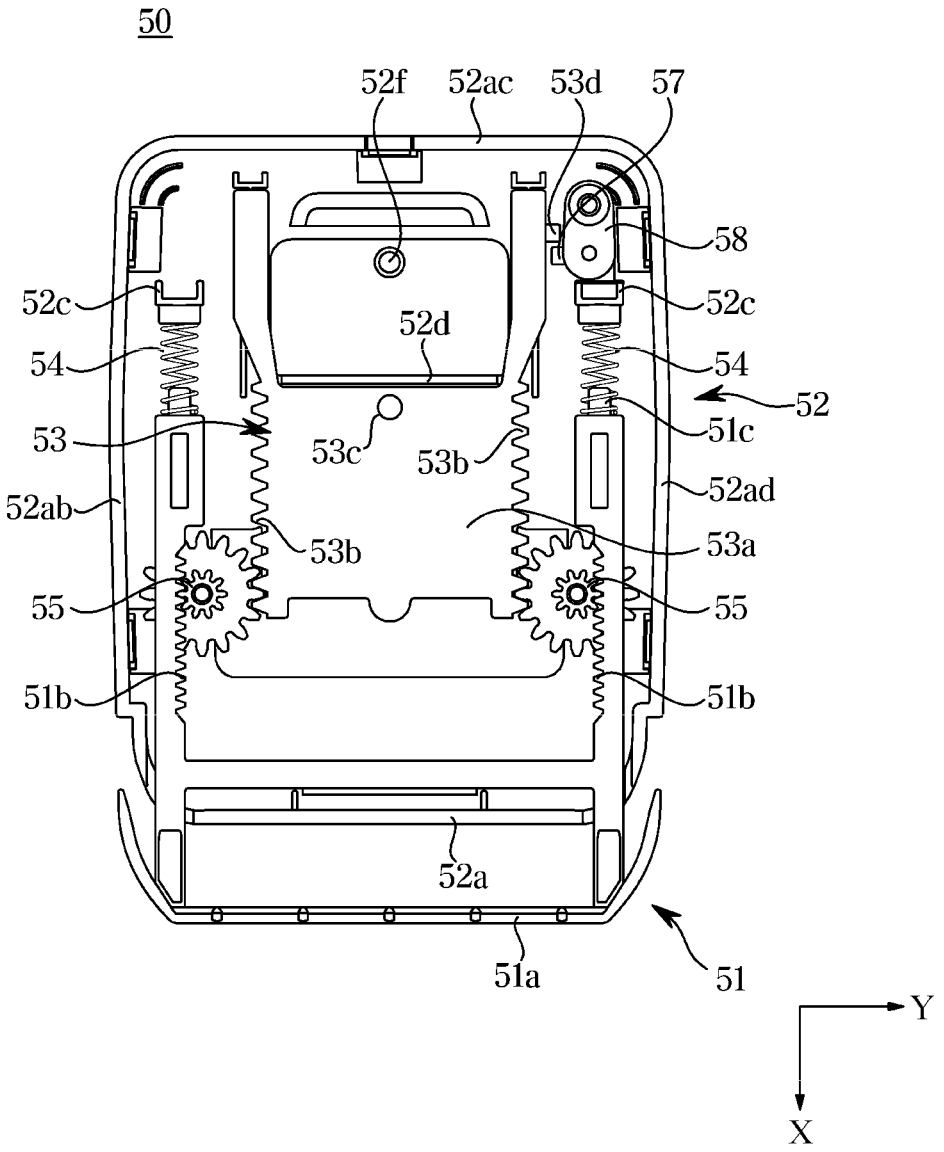
FIG. 8 shows the resting body and the push member coupled with the resting body before the push member shown in FIG. 5 is pressed.
Figure 9:
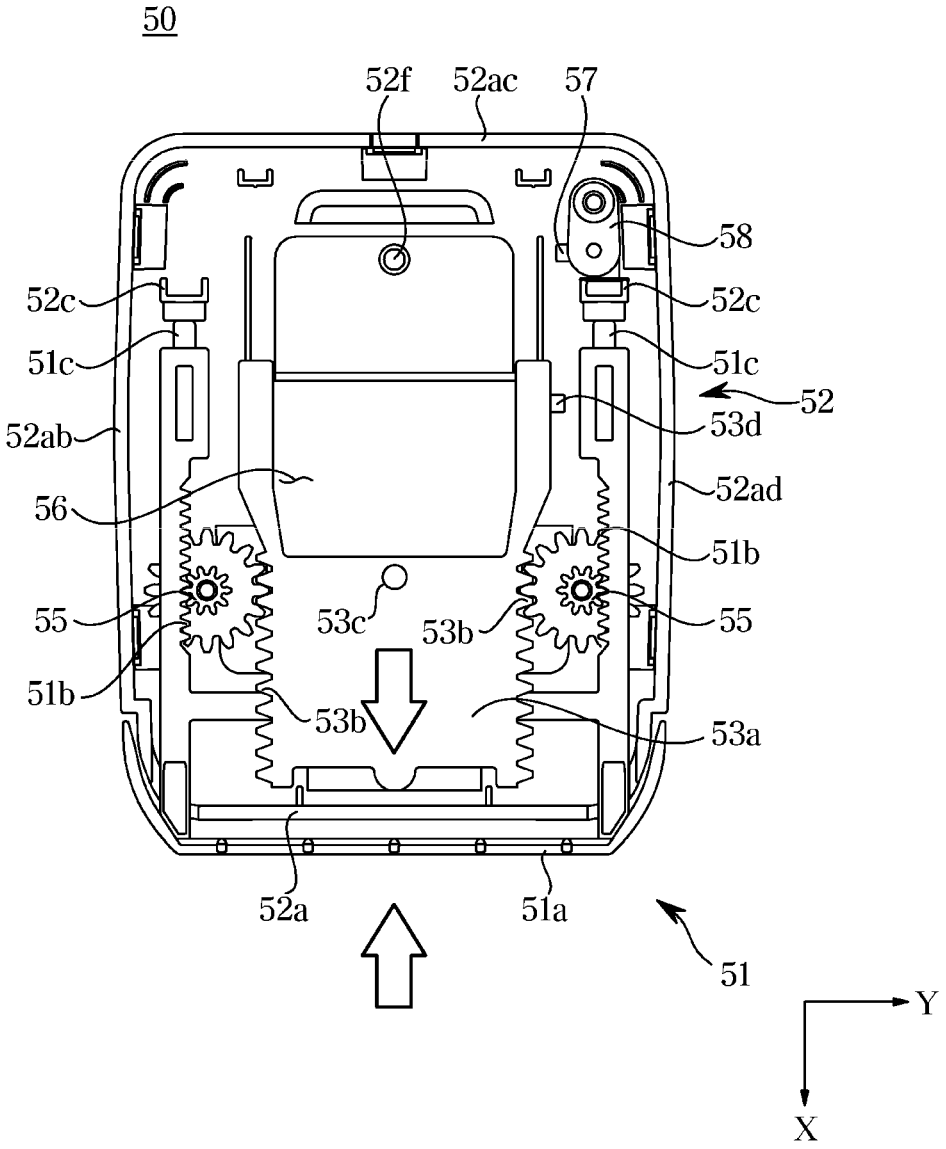
FIG. 9 shows the resting body and the push member coupled with the resting body after the push member shown in FIG. 5 is pressed.

A structure of the opening and closing device 50 of opening or closing the outlet 56 will be described in detail with reference to FIGS. 8 and 9. FIG. 8 shows the push member 51 located at a first position to close the outlet 56. FIG. 9 shows the push member 51 located at a second position to open the outlet 56.

The push member 51 may close the outlet 56 at the first position. The push member 51 may open the outlet 56 at the second position. More specifically, by the push member 51 being at the first position, the shutter 53 may be located at a first position to close the outlet 56. By the push member 51 being at the second position, the shutter 53 may be located at a second position to open the outlet 56. The push member 51 may move in the front direction (X direction) or the rear direction (−X direction) between the first position and the second position.

The push member 51 may be pressed to move in the rear direction (−X direction). In this case, because the shutter 53 moves in an opposite direction of the moving direction of the push member 51, the shutter 53 may move in the front direction (X direction). The push member 51 may move from the first position to the second position by a pressing operation. The shutter 53 may also move from the first position to the second position by the pressing operation. The first position of the push member 51 may be a more front position (X direction) than the second position. The second position of the shutter 53 may be a more front position (X direction) than the first position.

According to the movement of the push member 51 from the first position to the second position by a user's pressing operation, the spring 54 coupled with the spring holder 52*c* of the resting body 52 may elastically bias the push member 51 and move the push member 51 toward the first position. The spring 54 may be a pair of springs 54. By the structure, only while the user presses the button 51*a*, the outlet 56 may open. At a time at which the user takes a hand off the button 51*a*, the button 51*a* may return to the first position by the spring 54 to close the outlet 56. That is, the user may discharge grain through the outlet 56 only for a desired time period.

Figure 10:
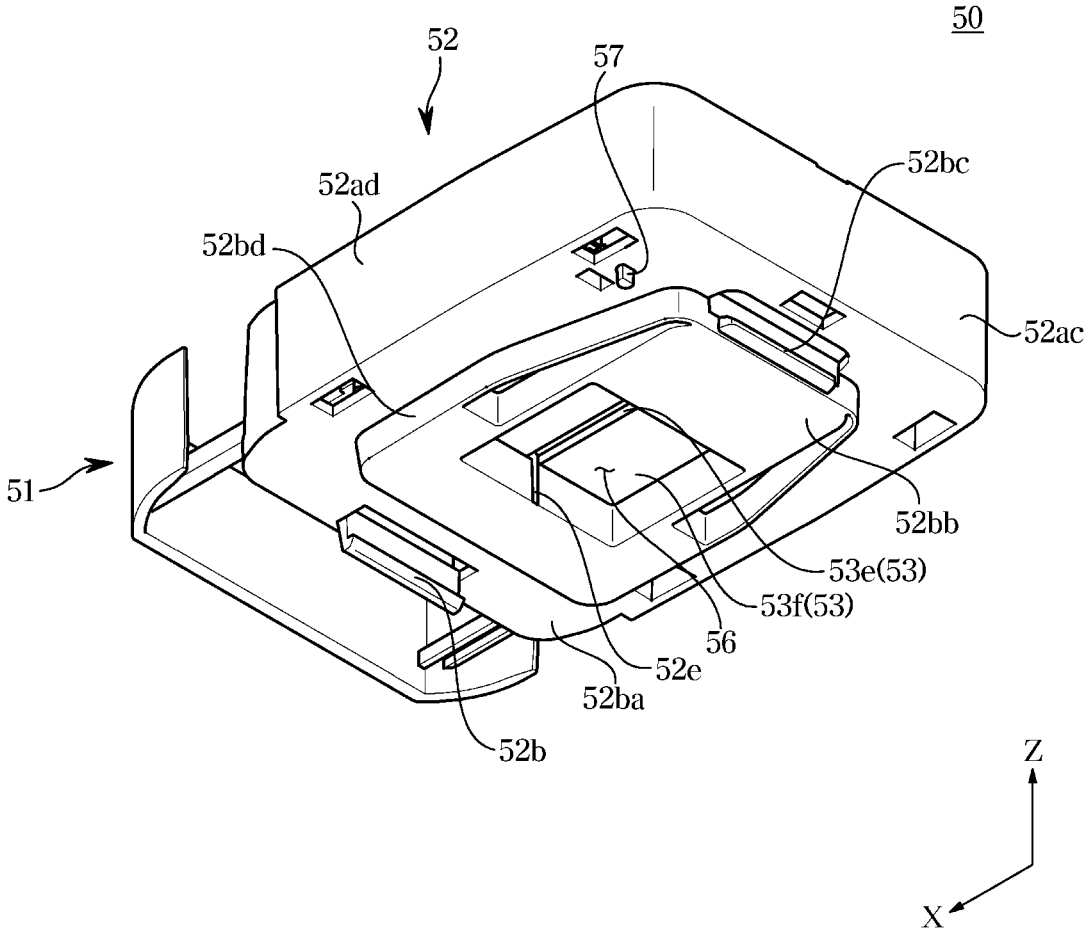
FIG. 10 is a bottom view showing a coupled state of the resting body and the push member shown in FIG. 5.
Figure 11:
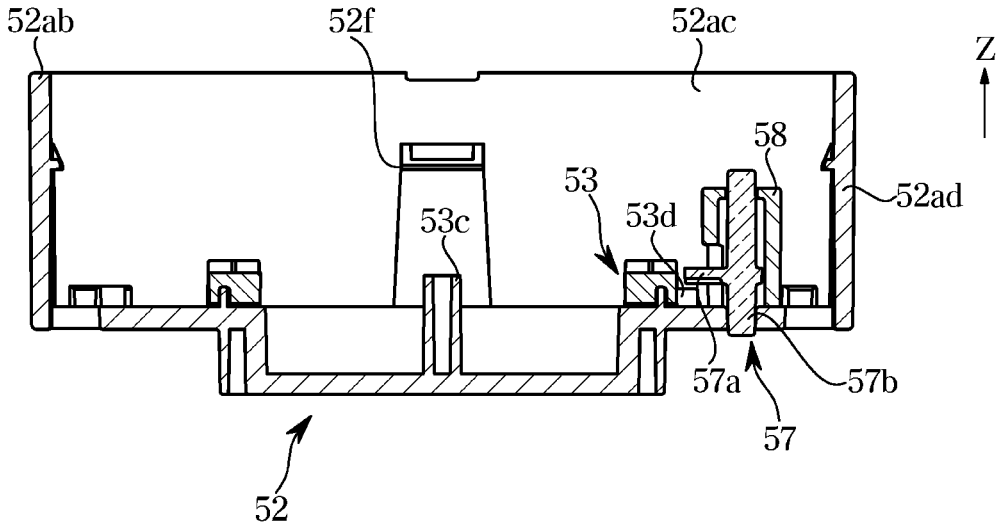
FIG. 11 is a cross-sectional view showing a state in which a locker shown in FIG. 6 does not lock the shutter.
Figure 12:
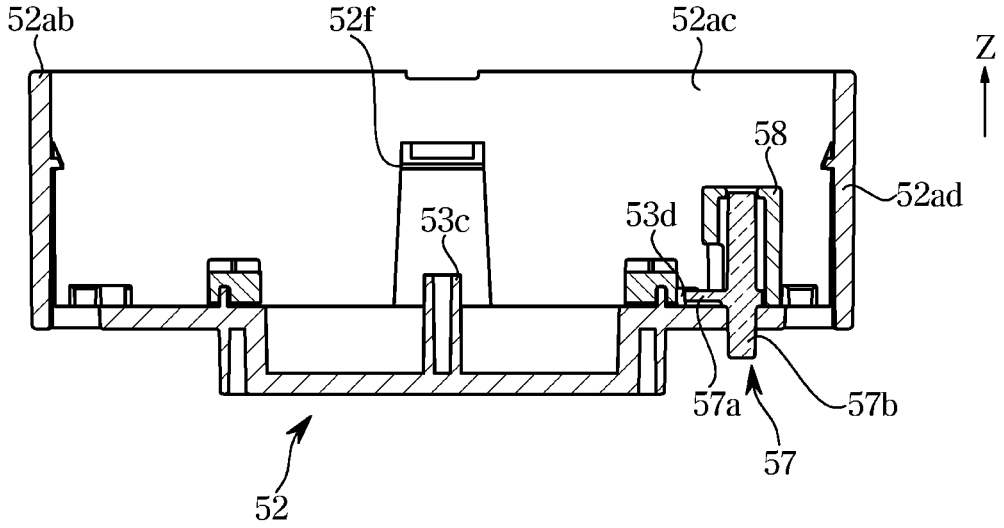
FIG. 12 is a cross-sectional view showing a state in which the locker shown in FIG. 6 locks the shutter.

A locking device of the locker 57 according to an example will be described in detail with reference to FIGS. 10 to 12. FIG. 11 is a front cross-sectional view showing a unlocked state of the locker 57. FIG. 12 is a front cross-sectional view showing a locked state of the locker 57.

The locker 57 may protrude downward (−Z direction) from the resting body 52 to the outside. The locker 57 may include a locker body 57*b* and a catching member 57*a*. The locker body 57*b* may extend in the up-down direction (Z direction). The locker 57 may include the catching member 57*a* protruding from the locker body 57*b* in a direction crossing an extension direction of the locker body 57*b*. The catching member 57*a* may interfere with the catching protrusion 53*d*.

Figure 7:
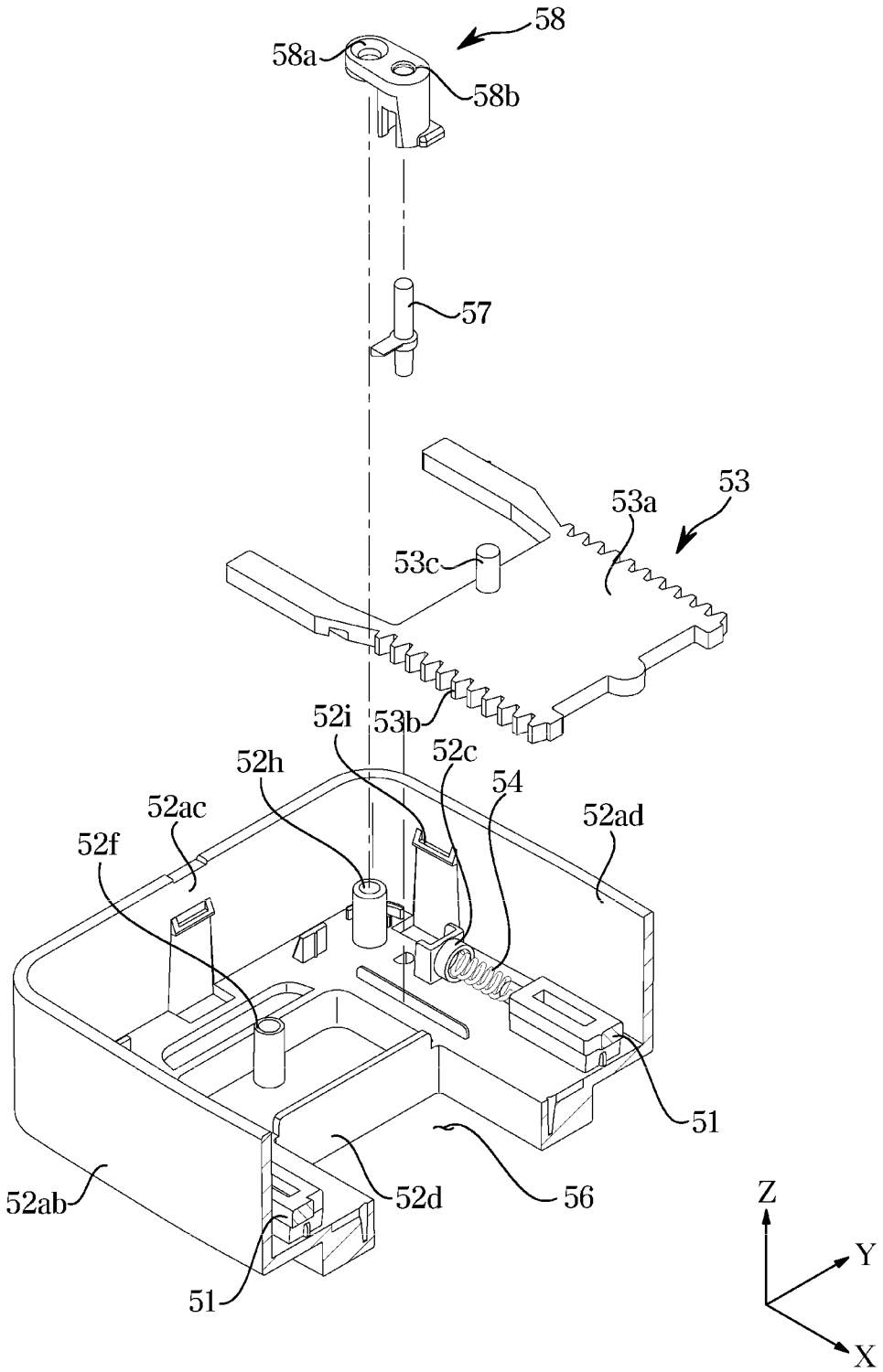
FIG. 7 shows a cross section of the resting body and a shutter shown in FIG. 5 at another angle.

The locker guide 58 may be coupled with the locker body 57*b* inserted into the locker hole 58*b* (see FIG. 7). The locker hole 58*b* may have a shape which corresponds to the locker body 57*b* and into which the locker body 57*b* is inserted. Through the locker hole 58*b*, the locker body 57*b* may be movable in the up-down direction (Z direction). Through the locker guide 58, the locker 57 may be coupled with the resting body 52 in such a way as to be movable in the up-down direction (Z direction).

Upon coupling of the opening and closing device 50 with the housing 70, a lower end of the locker body 57*b* may be in contact with the resting surface 75 of the housing 70, and the locker body 57*b* may move upward (in the Z direction) (see FIG. 5). As the locker body 57*b* moves upward (in the Z direction), the catching member 57*a* protruding from the locker body 57*b* may also move upward (in the Z direction). As the resting body 52 is rested on the housing 70 (see FIG. 5), the catching member 57*a* may be spaced upward (in the Z direction) from the resting body 52. As the catching member 57*a* is spaced upward (in the Z direction) from the resting body 52, the catching member 57*a* may make a height difference with respect to the catching protrusion 53*d* of the shutter 57. That is, because the catching protrusion 53*d* does not interfere with the catching member 57*a*, the shutter 53 including the catching protrusion 53*d* may be movable in the front direction (X direction). By the structure, after the opening and closing device 50 is rested on the housing 70 (see FIG. 5), a user may press the button 51*a* (see FIG. 5) to move the shutter 53. That is, the user may discharge grain through the outlet 56.

Upon separating of the opening and closing device 50 from the housing 70, the lower end of the locker body 57*b* may be in non-contact with the resting surface 75 of the housing 70, and accordingly, the locker body 57*b* may move downward (in the −Z direction) by an own weight (see FIG. 5). As the locker body 57*b* moves downward (in the −Z direction), the catching member 57*a* protruding from the locker body 57*b* may also move downward (in the −Z direction). As a result of separating of the resting body 52 from the housing 70 (see FIG. 5), the catching member 57*a* may be in contact with the resting body 52. The catching member 57*a* being in contact with the resting body 52 may interfere with the catching protrusion 53*d* of the shutter 53. After the opening and closing device 50 is separated from the housing 70 (see FIG. 5), the shutter 53 will not move by a user's operation of pressing the button 51*a* (see FIG. 5). That is, after the opening and closing device 50 is separated from the food withdrawal portion 60 (see FIG. 2), the shutter 53 may be prevented from moving by interference of the locker 57 to prevent the outlet 56 from opening.

By the structure, although the button 51*a* (see FIG. 5) is pressed by a user's mistake or another object after the food storage portion 30 (see FIG. 2) is separated from the food withdrawal portion 60 (see FIG. 2), grain may be prevented from being discharged through the outlet 56. The user may easily clean the food storage portion 30 (see FIG. 2) by separating the food storage portion 30 (see FIG. 2) from the refrigerator 1, and grain may be prevented from being discharged in an unintended situation.

Figure 13:
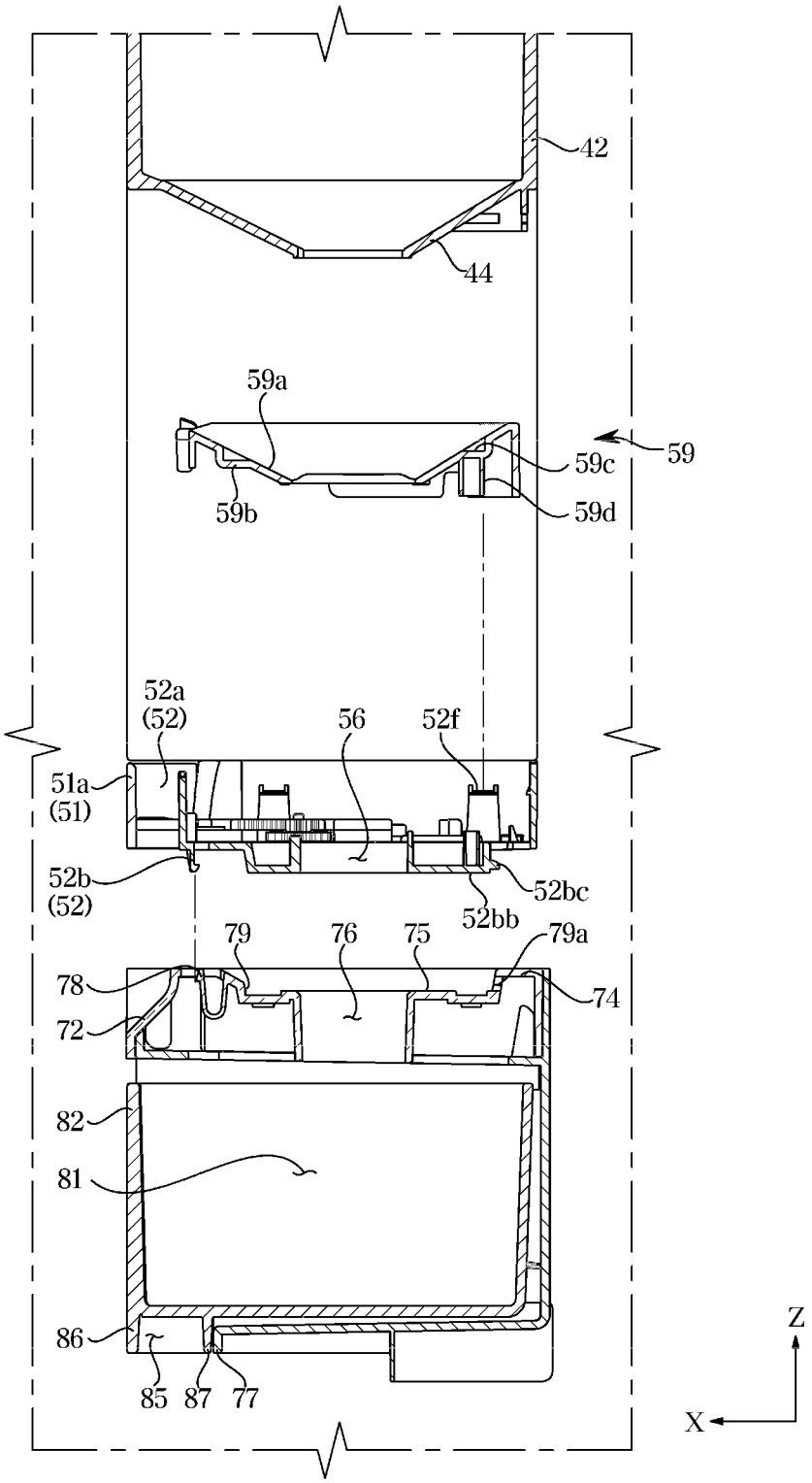
FIG. 13 is a cross-sectional view showing a state in which a storage body, an opening and closing device, and the food withdrawal portion, shown in FIG. 5, are coupled.

A process of coupling the storage body 42 of the food storage case 40, the coupling member 59, the resting body 52, and the housing 70 will be described in detail with reference to FIGS. 5, 10, and 13.

The resting body 52 may include a lower surface 52*ba* being in contact with the housing 70 and a protrusion wall 52*bd* protruding downward from the lower surface 52*ba*. The resting body 52 may include a resting surface 52*bb* extending from one end of the protrusion wall 52*bd* and being in contact with the housing 70. The resting surface 52*bb* may be formed by extending from a lower end of the protrusion wall 52*bd*. The resting surface 52*bb* and the protrusion wall 52*bd* may form a portion of the outlet 56.

The resting body 52 may include a coupling protrusion 52*b* and an insertion protrusion 52*bc* protruding downward from the lower surface 52*ba* toward the rear direction (−X direction). The coupling protrusion 52*b* may be positioned in front of the outlet 56 (in the X direction), and the insertion protrusion 52*bc* may be positioned behind the outlet 56 (in the −X direction).

The resting body 52 may include a first bottom protrusion 52*e* being adjacent to the outlet 56. The first bottom protrusion 52*e* may prevent the shutter 53 located at the first position from moving in the rear direction (−X direction). The first bottom protrusion 52*e* may prevent the shutter 53 located at the second position from moving in the front direction (X direction).

Figure 6:
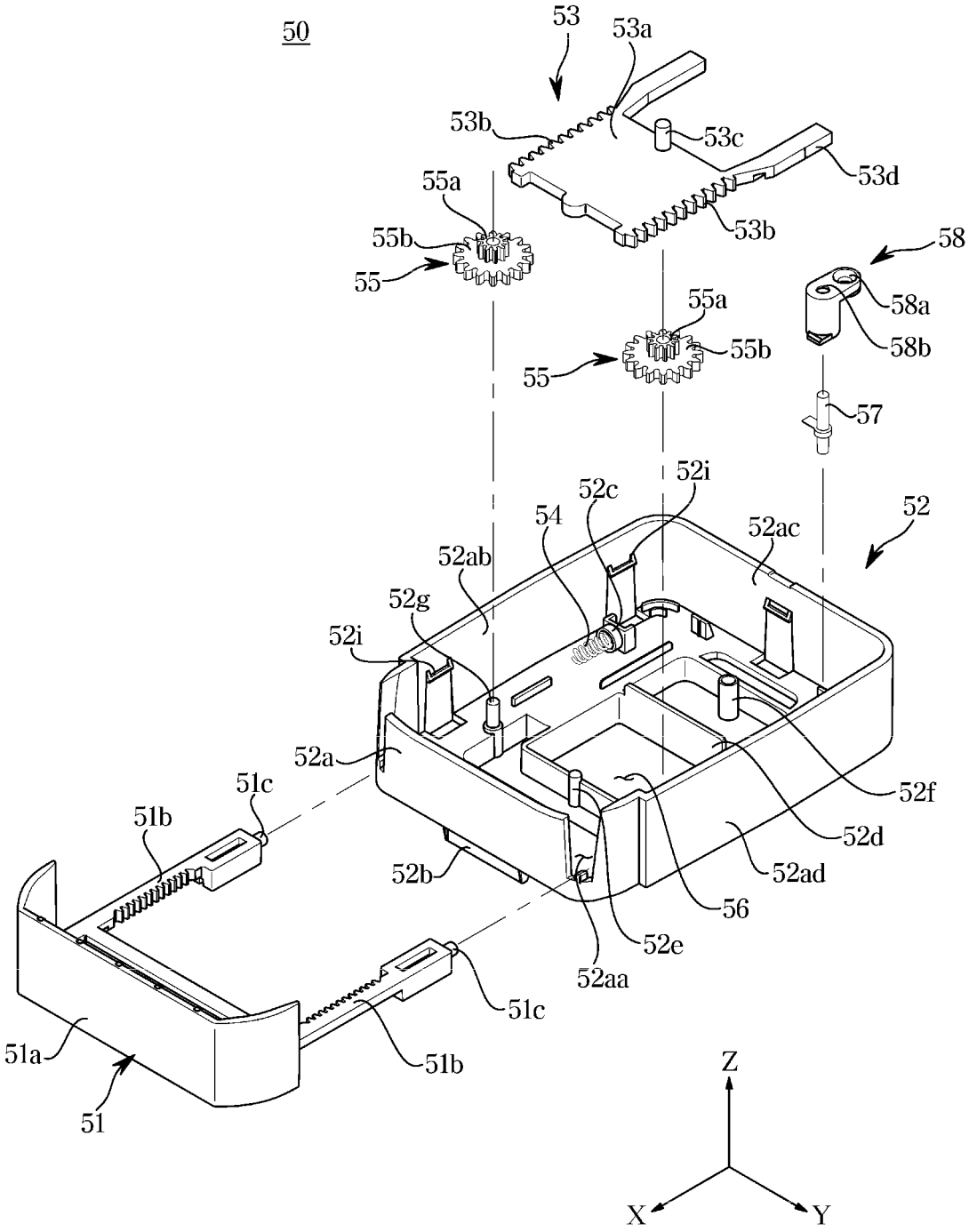
FIG. 6 is an exploded view of a push member and a resting body shown in FIG. 5.

The shutter 53 may include a lower surface 53*f* of the shutter body 53*a* (see FIG. 6). The shutter 53 may include a protrusion guide 53*e* corresponding to the first bottom protrusion 52*e*. The protrusion guide 53*e* may be embossed upward from the lower surface 53*f*. The guide surface 53*e* may extend in the front-rear direction (X direction) to prevent the first bottom protrusion 52*e* from moving at one end and the other end.

The housing 70 may include the upper surface 74 and the side wall 79 recessed downward from the upper surface 74 to guide the resting body 52. The upper surface 74 may correspond to the lower surface 52*ba* of the resting body 52, and the lower surface 52*ba* of the resting body 52 may be rested on the upper surface 74.

The housing 70 may extend a guide surface 75 extending from one end of the side wall 79 and forming the food communicating opening 76. The guide surface 75 may be formed by extending from a lower end of the side wall 79. The guide surface 75 may correspond to the resting surface 52*bb* of the resting body 52, and the guide surface 75 may be rested on the resting surface 52*bb* of the resting body 52.

That is, by resting the resting surface 52*bb* on the guide surface 75, the lower surface 52*bc* may be rested on the upper surface 74, and thereby, the resting body 52 may be coupled with the housing 70. After the resting body 52 is coupled with the housing 70, the protrusion wall 52*bd* may be in contact with the side wall 79.

The food communicating opening 76 may communicate with the outlet 56 to move grain stored in the storage body 42 to the accommodating space 81.

The housing 70 may include a fixing protrusion 78 positioned in front of the food communicating opening 76 (in the X direction), and a protrusion inserting hole 79*a* positioned behind the food communicating opening 76 (−X direction). The fixing protrusion 78 may be hook-coupled with the resting body 52. The resting body 52 may be inserted into the protrusion inserting opening 79*a*. The protrusion inserting hole 79*a* may be formed behind the side wall 79 (in the −X direction).

The protrusion inserting opening 79*a* may correspond to the inserting protrusion 52*bc*, and the inserting protrusion 52*bc* may be inserted into the protrusion inserting opening 79*a*. The inserting protrusion 52*bc* of the resting body 52 may be inserted into the protrusion inserting opening 79*a*, and the coupling protrusion 52 may be hook-coupled with the fixing protrusion 78. By the structure, the resting body 52 may be easily detachably coupled with the housing 70. A user may separate the food storage case 40 or the housing 70 from the refrigerator 1 with a small force, and accordingly, the user may feel comfortable upon cleaning. In addition, the user who wants to store food in the food storage case 40 may separate the food storage case 40 from the housing 70 to easily put grain in the food storage case 40.

The food withdrawal container 80 may include the front wall 82 forming a front side (X direction) of the accommodating space 81, and a front wall protrusion 86 protruding downward from the front wall 82. The food withdrawal container 80 may include an inner wall 87 spaced from the front wall protrusion 86 and forming a guide groove 85. An inner wall holder 77 may be positioned behind the inner wall 87 (−X direction). The user may withdraw the food withdrawal container 80 in the front direction (X direction) by inserting a finger into the guide groove 85 to obtain discharged grain.

The storage body 42 may store grain therein, and include an inclined surface 44 at a lower side. The inclined surface 44 may form an opening communicating with the outlet 56. Grain may be guided along the inclined surface 44 toward the outlet 56.

The coupling member 59 may be provided between the storage body 42 and the resting body 52. The coupling member 59 may include an inclined surface 59*a* corresponding to the inclined surface 44. The coupling member 59 may include a front groove 59*b* positioned in the front direction (X direction) and a rear groove 59*c* positioned in the rear direction (−X direction). The coupling member 59 may include a lower protrusion 59*d* protruding downward (in the −Z direction) from the rear groove 59*c*.

The coupling member 59 may be coupled with the resting body 52 through the lower protrusion 59*d* and the second bottom protrusion 52*f*. By the structure, in the food dispenser 20 installed on the doors 2 and 3 of the refrigerator 1, dusts may be prevented from being generated by acceleration or an impact caused upon opening or closing of the doors 2 and 3.

According to an aspect, the food dispenser may be easily separated from the refrigerator.

According to another aspect, a user may feel comfortable by cleaning each food dispenser without any inconvenience.

According to still another aspect, while the food storage case is separated from the refrigerator or the food withdrawal portion, food stored in the food storage case may be prevented from pouring.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A refrigerator comprising:

a storage room;

a door to open and close the storage room; and a food dispenser attachable to and detachable from an interior side of the door, wherein the food dispenser includes, a food storage portion having a food storage case to store an item, and an opening and closing assembly coupleable to a lower portion of the food storage case to control discharge of the item stored in the food storage case, and a food withdrawal portion, arrangeable below the food storage portion, such that while the food withdrawal portion is arranged below the food storage portion, the item discharged from the food storage portion is accommodated in the food withdrawal portion, wherein the opening and closing assembly includes, a resting body having an outlet through which the item stored in the food dispenser is discharged, the resting body being attachable to and detachable from an upper surface of the food withdrawal portion, a push member coupleable to the resting body in such a way as to be movable along a front-rear direction of the food dispenser while being coupled to the resting body, and a shutter movable along the front-rear direction of the food dispenser which is opposite to a moving direction of the push member by interworking with the push member whereby the shutter moves along a first direction of the front-rear direction to open the outlet of the resting body and discharge the item, and the shutter moves along a second direction of the front-rear direction to close the outlet of the resting body and maintain the item in the food storage portion.

2. The refrigerator of claim 1, wherein the push member is movable between a first position of closing the outlet and a second position of opening the outlet.

3. The refrigerator of claim 2, wherein the push member includes:

a button positioned in front of the resting body; and a first rack gear formed to extend from the button to the resting body, and positioned at both sides of the outlet.

4. The refrigerator of claim 3, wherein the shutter includes a second rack gear being movable along the opposite direction of the moving direction of the push member between the first position of closing the outlet and the second position of opening the outlet by interworking with the push member.

5. The refrigerator of claim 4, wherein the opening and closing assembly further comprises a transfer gear moving the second rack gear along an opposite direction of a moving direction of the first rack gear, while changing a gear ratio of the first rack gear and the second rack gear.

6. The refrigerator of claim 3, wherein the opening and closing assembly further comprises a pair of springs of which a first end is fixed to the resting body and a second end is coupled with the first rack gear, wherein the pair of springs elastically bias the push member to move the push member to the first position.

7. The refrigerator of claim 1, wherein the shutter further includes a shutter protrusion preventing the item from being lumped together.

8. The refrigerator of claim 1, wherein the food storage case further comprises:

a cover opening and closing the food storage case; and a coupling member coupling the food storage case with the resting body.

9. A refrigerator comprising:

a storage room;

a door to open and close the storage room; and a food dispenser attachable to and detachable from an interior side of the door, wherein the food dispenser includes, a food storage portion having a food storage case to store an item, and an opening and closing assembly coupleable to a lower portion of the food storage case to control discharge of the item stored in the food storage case, and a food withdrawal portion, arrangeable below the food storage portion, such that while the food withdrawal portion is arranged below the food storage portion, the item discharged from the food storage portion is accommodated in the food withdrawal portion, wherein the opening and closing assembly includes, a resting body having an outlet through which the item stored in the food dispenser is discharged, the resting body being attachable to and detachable from an upper surface of the food withdrawal portion, a push member coupleable to the resting body in such a way as to be movable along a front-rear direction of the food dispenser while being coupled to the resting body, a shutter movable along an opposite direction of a moving direction of the push member by interworking with the push member, and opening and closing the outlet, and a locker to limit movement of the shutter.

10. The refrigerator of claim 9, wherein the shutter further includes a catching protrusion, and the locker includes a locker body, and a catching member formed to protrude from the locker body and prevent the catching protrusion from moving.

11. The refrigerator of claim 9, wherein the opening and closing assembly further comprises a locker guide coupled with the food withdrawal portion and guiding an up-down movement of the locker.

12. The refrigerator of claim 11, wherein the food withdrawal portion comprises a housing on which the resting body is rested, and a food withdrawal container being withdrawable from the housing to an outside of the housing, and the housing is hook-coupled with the resting body.

13. The refrigerator of claim 12, wherein the housing comprises an upper surface, a side wall recessed downward from the upper surface and guiding the resting body, and a guide surface extending from the side wall, and the resting body comprises a lower surface corresponding to the upper surface and coupled with the upper surface, and a resting surface recessed downward from the lower surface and rested on the guide surface.

14. The refrigerator of claim 13, wherein the resting body includes an insertion protrusion protruding downward from the lower surface toward a rear direction, and a coupling protrusion located at a more front position than the insertion protrusion, and the housing comprises an insertion groove in which the insertion protrusion is inserted, and a fixing protrusion hook-coupled with the coupling protrusion.

15. The refrigerator of claim 9, wherein the locker unlocks the shutter upon coupling of the resting body with the food withdrawal portion.

* * * * *